US007449870B2

(12) United States Patent
Cebry

(10) Patent No.: US 7,449,870 B2
(45) Date of Patent: Nov. 11, 2008

(54) CIRCUITRY AND METHOD FOR LIMITING PEAK CURRENT FROM A VOLTAGE SOURCE

(75) Inventor: George L. Cebry, Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 357 days.

(21) Appl. No.: 11/349,369

(22) Filed: Feb. 6, 2006

(65) Prior Publication Data

US 2007/0182389 A1 Aug. 9, 2007

(51) Int. Cl.
*G05F 1/40* (2006.01)

(52) U.S. Cl. ..... 323/285; 323/284; 323/908

(58) Field of Classification Search ..... 363/73; 323/222, 275, 284, 285, 288, 908
See application file for complete search history.

(56) References Cited

U.S. PATENT DOCUMENTS 4,731,574 A * 3/1988 Melbert ..... 323/275
5,264,782 A * 11/1993 Newton ..... 323/288
5,408,173 A * 4/1995 Knapp ..... 323/285
7,279,878 B2 * 10/2007 Ootani et al. ..... 323/285

* cited by examiner

*Primary Examiner*—Jessica Han
(74) *Attorney, Agent, or Firm*—Ingrassia, Fisher & Lorenz, P.C.

(57) ABSTRACT

Circuitry (20) and a method are provided for limiting peak current while supplying a constant voltage to a load (42). The circuit (20) comprises an input terminal (32) for coupling to the voltage supply, current sense circuitry (26) coupled to the input terminal (32), a capacitor (30) coupled to an output terminal (40), a converter power stage (22) coupled between the current sense circuitry (26) and the output terminal (40); and a converter controller (24) having inputs coupled to the output terminal (40) and the current sense circuitry (26), and an output coupled to the converter power stage (22) for switching the converter power stage (22) from a voltage mode to a current mode.

6 Claims, 3 Drawing Sheets

CIRCUITRY AND METHOD FOR LIMITING PEAK CURRENT FROM A VOLTAGE SOURCE

STATEMENT REGARDING FEDERALLY SPONSORED RESEARCH OR DEVELOPMENT

This invention was made with Government support under Contract No. LES76BT476 awarded by Raytheon. The Government has certain rights in this invention

FIELD OF THE INVENTION

The present invention generally relates to voltage supplies and more particularly to a circuit and method for limiting the peak current while supplying a constant voltage to a load.

BACKGROUND OF THE INVENTION

Voltage supplies for electronic circuits are well known. While a constant voltage is applied to a load, the current will vary if the resistance of the load changes. This is especially applicable when supplying a voltage to a bus having a varying number of loads coupled thereto. Difficulty arises when the peak current demand by the loads exceeds system capabilities, e.g., the circuit elements, fuses or conductive lines of the voltage supply cannot carry the peak current.

Accordingly, it is desirable to provide a circuit and method for limiting the peak current while supplying a constant voltage to a load. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A circuit and method are provided for limiting the peak current while supplying a constant voltage to a load. The circuit comprises an input terminal for coupling to the voltage supply, current sense circuitry coupled to the input terminal, a capacitor coupled to an output terminal, a converter power stage coupled between the current sense circuitry and the output terminal; and a converter controller having inputs coupled to the output terminal and the current sense circuitry, and an output coupled to the converter power stage for switching the converter power stage from a voltage mode to a current mode.

BRIEF DESCRIPTION OF THE DRAWINGS

The present invention will hereinafter be described in conjunction with the following drawing figures, wherein like numerals denote like elements

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In order to limit a peak current on a system bus, subsystems (a load) are isolated from the bus by a DC to DC converter. A capacitor is coupled to the output of the converter for providing a current limit to the bus. When a large current pulse is drawn by the subsystems, the energy is supplied by the charge stored in the capacitor. As the voltage on the capacitor drops, the DC to DC converter switches from a voltage mode operation to a current mode operation. This current mode limits the bus current to a set value.

Figure 1:
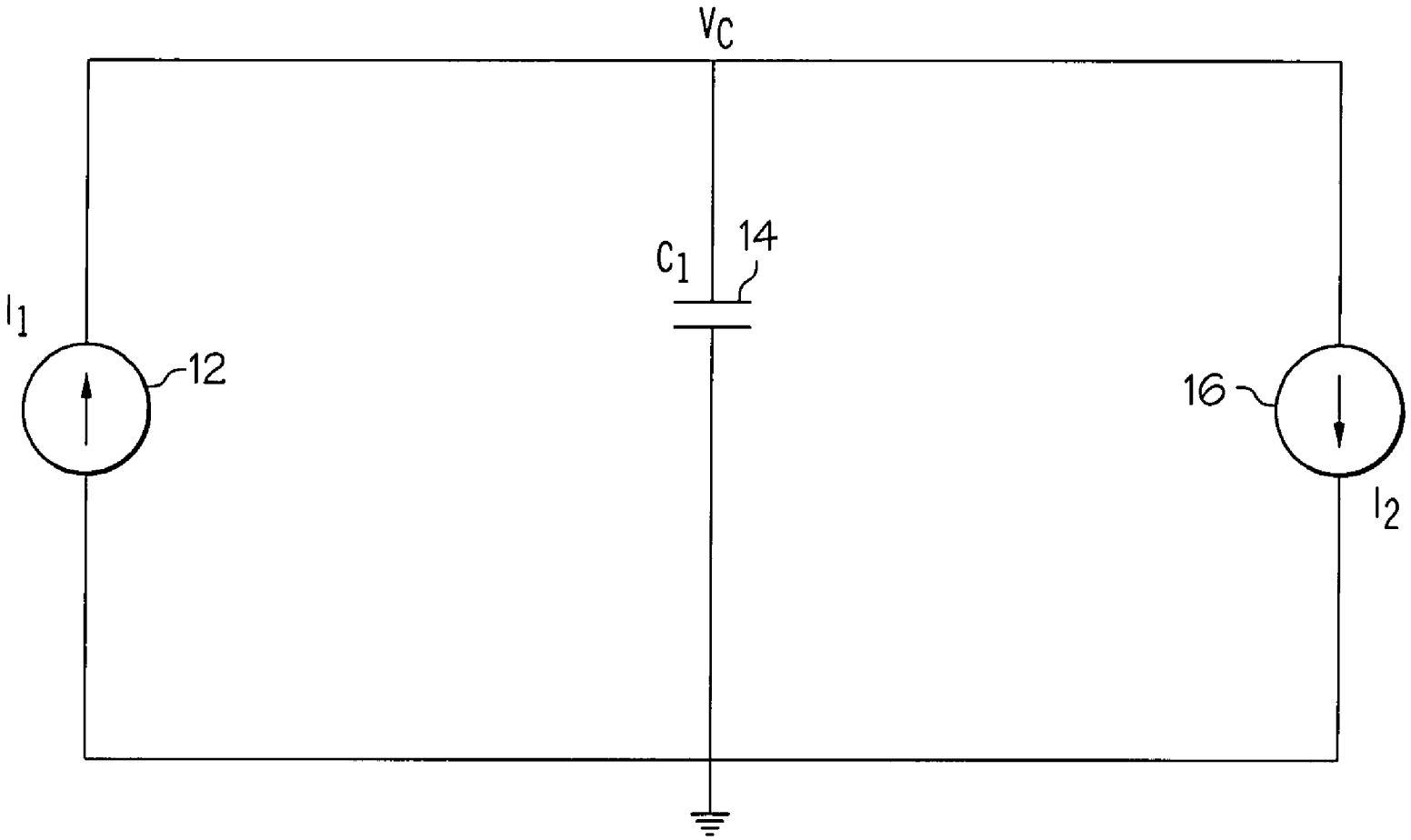
FIG. 1 is a schematic showing the basic concept of an exemplary embodiment.
Figure 2:
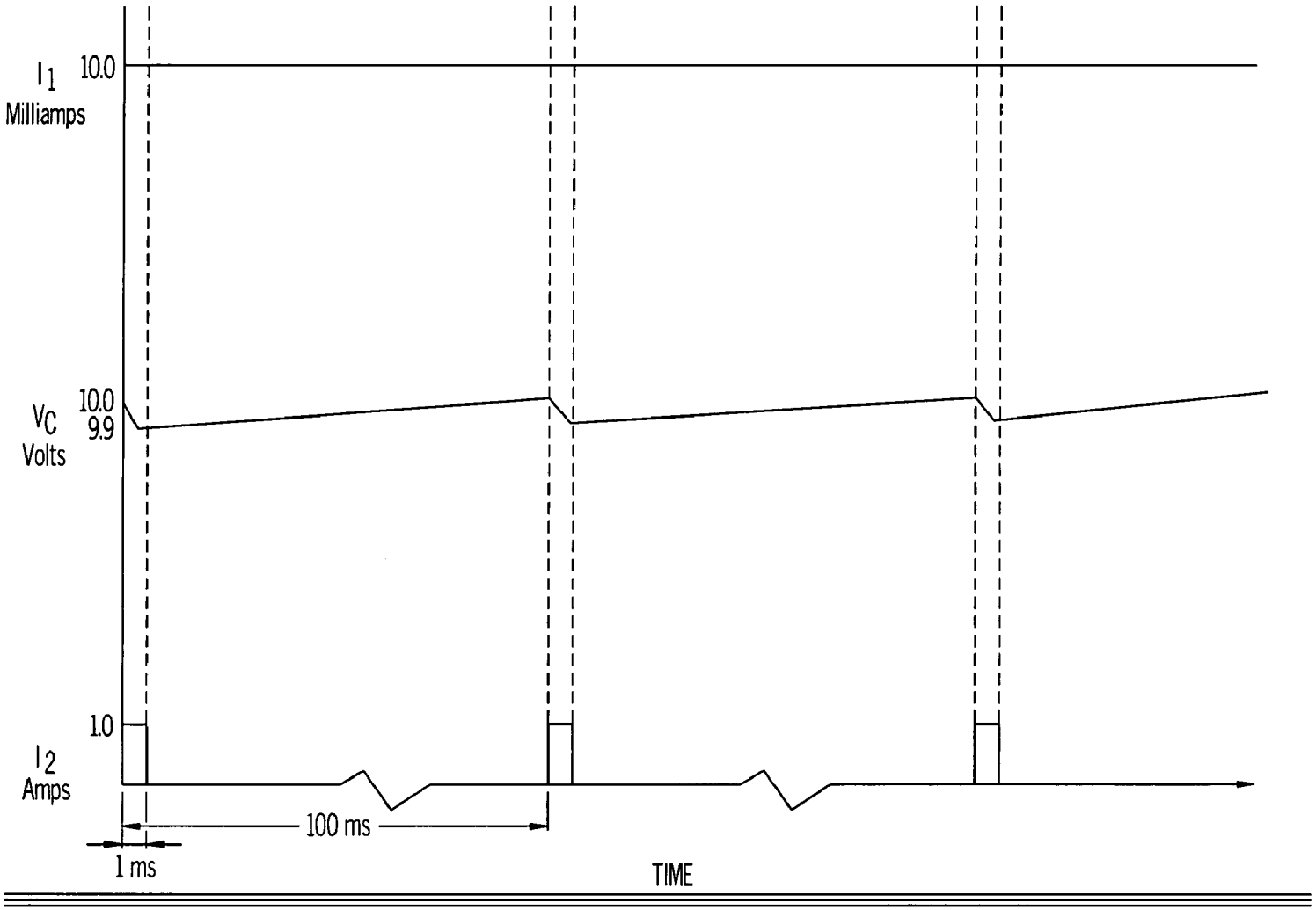
FIG. 2 is the voltage and current waveforms of the exemplary embodiment of FIG. 1.

The general concept of an exemplary embodiment may be understood by referring to FIGS. 1 and 2. A current source 12 having a current $I_1$ is coupled in parallel with a storage capacitor 14 having a capacitance $C_1$ and a pulsed current $I_2$. The waveforms for the circuit elements of FIG. 1 are shown in FIG. 2. Exemplary values for the circuit elements are $I_1$ is 10 milliamp, $C_1$ is 10,000 microfarad, I2 is one amp. It is seen that the voltage Vc across the capacitor 14 assumes a sawtooth waveform between 10 volts and 9.9 volts. The pulsed $I_2$ has a one millisecond duration spaced apart by 99 milliseconds resulting in a duty cycle of 0.01.

The ripple voltage across the storage capacitor 14 would be set, for example, at 99 millivolts. The storage capacitor value would be calculated based on the ripple voltage and the load current level and duration. For example, for a load current $I_2$ of one amp with a pulse duration of 1 millisecond and off for 99 milliseconds, and since the voltage across the capacitor for a fixed current is defined as dv=Idt/C1, then $$C_1=I(dt/dv)=(1-0.01\text{ amp})(1\text{ millisecond})/99\text{millivolts}=10{,}000\text{ microfarad.}$$

The initial value of the current source 12 current needed to recharge the storage capacitor 14 is determined, for example, for an initial voltage of 10 volts, a period of charge of 99 milliseconds, and a ripple voltage of 99 millivolts, and since I=C1(dv/dt), the current source current, then $$I_1=(10{,}000\text{ microfarad})(99\text{ millivolts})/99\text{milliseconds}=0.01\text{ amps.}$$

Figure 3:
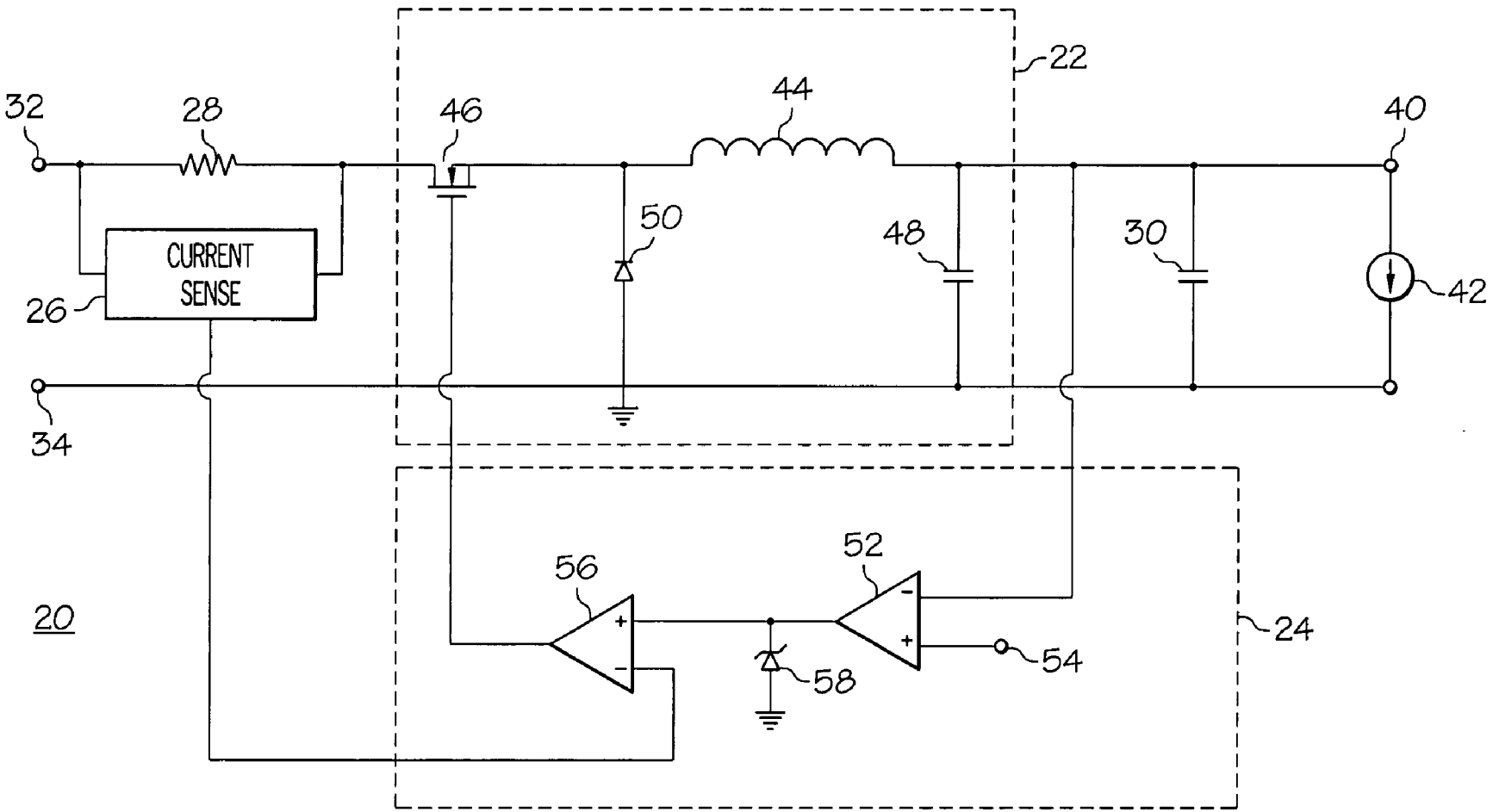
FIG. 3 is a schematic of an exemplary embodiment.

Referring to FIG. 3, the device 20 includes a converter power stage 22, a converter controller 24, current sense circuitry 26, a resistor 28, and a capacitor 30. Voltage supply positive terminal 32 is connected to the resistor 28 and voltage bus negative terminal 34 is coupled to the converter power state 22. A subsystem 42 is coupled across the capacitor 30. The converter power stage 22 is shown using a DC-DC Buck Converter Topology but any converter topologies may be used.

The converter power stage 22 includes an inductor 44 coupled between an output node 40 and a transistor 46. The transistor 46 is represented by a MOSFET, but may comprise any switching element coupled between the inductor 44 and the resistor 28, and may alternatively be incorporated in the current sense circuitry 26. A capacitor 48 is coupled between the output node 40 and the voltage supply negative terminal 34. A diode 50 has a cathode connected between the inductor 44 and the switch 46, and an anode connected to the voltage supply negative terminal 34. Note that the diode 50 can be replaced with any type of electronic switch such as a MOSFET. The switch is only shown here as a diode to simplify the operational definition.

The converter controller 24 comprises a voltage error amplifier 52 having a negative input connected to the output node 40, and a positive input coupled to a reference voltage 54. An output of the voltage error amplifier 52 is connected to both the positive input of a pulse width modulator comparator 56 and to the cathode of a zener 58. The pulse width modulator comparator 56 has a negative input coupled to the current sense circuit 26, and an output coupled to control the switch 46. The current sense circuit 26 may comprise any type of circuitry to derive the current passing through the resistor 28. Alternatively, the current may be sensed, for example, by a current transformer. The sensing of the current would preferably be accurate, wideband, and relatively noise free.

For the exemplary embodiment, component values are resistor 28: 0.1 ohms, capacitor 30: 10,000 uF; inductor 44: 10 uF, and capacitor 48: 10 uF. The voltage applied to terminals 32 and 34 may be between 15 and 30 volts, but preferably would be 20 volts.

The voltage mode and current mode are two regulating conditions that control the input to a load. Most applications call for a voltage supply to be used as a voltage source, which generally requires less power that when uses as a current source. A voltage source provides a constant output voltage as current is drawn from zero to full rated current of the supply. In these applications, the power supply runs in the voltage mode, maintaining a constant output voltage while providing the required current to the load.

The current mode works in a similar fashion, except it limits and regulates the output current of the supply to a desired level. When the voltage supply runs in current mode, the voltage supply provides a constant current to the load.

In operation, as a voltage from a voltage source is applied to the terminals 32 and 34, the voltage appears at the output node 40 (switch 46 is closed). The capacitor 30 charges and the voltage is applied to the subsystem 42. The voltage error amplifier 52 senses the voltage on output node 40, and when below the voltage reference 54, provides a positive voltage level to the positive input of the pulse width modulator comparator 56. The pulse width modulator 56 opens the switch 46 when the positive voltage input is less than the negative input voltage, the negative input voltage being derived from the current sense circuit 26. The capacitor 30 then supplies current to the load 42 thus maintaining a constant voltage across the load. This on/off cycle repeats and the pulse width modulator 56 adjusts the duty cycle when the bus voltage or load varies to maintain a constant output voltage. However, when a large load is applied, the error amplifier 52 tries to put out a positive voltage greater than the zener voltage 58, but the zener voltage clamps it to it's selected value. This prevents the pulse width modulator 56 from increasing the duty cycle to maintain constant output voltage and goes into current mode control versus voltage mode control. In current mode control, the pulse width modulator 56 limits the duty cycle to maintain a constant current on the bus voltage 32 defined by (zener voltage 58)/(current sense resistor 28). This provides a constant current to the output load 42. Since the constant current provided to the output is less than the load current 42, the output voltage will begin to drop, but storage capacitor 30 will not allow it to drop below the design voltage ripple limit. The voltage ripple limit requirement is specified by load 42. The storage capacitor 30 value and output constant current limit are then calculated based on the voltage ripple requirement. The voltage ripple in the storage capacitor is define as dv=I*dt/C=voltage ripple=(output load current−output constant current)*(output load current on time)/(Output storage capacitor 30).

These two regulating modes work together to provide continuous control of the supply, but with only one mode regulating at a time. Automatic crossover from voltage mode to current mode is inherent in the design so the maximum output voltage and current of the supply can be controlled under all operating conditions.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A circuit for limiting current from a voltage supply, comprising:
- an input terminal for coupling to the voltage supply;
- an output terminal;
- current sense circuitry coupled to the input terminal;
- a capacitor coupled to the output terminal;
- a converter power stage coupled between the current sense circuitry and the output terminal; and
- a converter controller comprising:
  - a voltage error amplifier having a negative input coupled to the output terminal and a positive input coupled to a first reference voltage; and
  - a pulse width modulator comparator having a positive input coupled to the output of the voltage error amplifier, a negative input coupled to the current sense circuit, and an output coupled to the converter power stage for switching the converter power stage from a voltage mode to a current mode.

2. The circuit of claim 1 further comprising a resistor coupled between the converter power stage and the input terminal, the current sense circuit sensing the current through the resistor.

3. The circuit of claim 1 wherein the pulse width modulator comparator comprises a switch driver having a first terminal connected to the output of the voltage error amplifier and a second terminal coupled to a second reference voltage.

4. A circuit for limiting current from a voltage supply, comprising:
- a first power supply input terminal;
- a second power supply input terminal;
- an output terminal;
- a current sense circuit coupled to the first power supply input terminal;
- a capacitor coupled between the output terminal and the second power supply input terminal;
- a converter power stage coupled between the current sense circuitry and the output terminal; and
- a voltage error amplifier having a negative input coupled to the output terminal and a positive input coupled to a first reference voltage; and
- a pulse width modulator comparator having a positive input coupled to the output of the voltage error amplifier, a negative input coupled to the current sense circuit, and an output coupled to the converter power stage for switching the converter power stage from a voltage mode to a current mode.

5. The circuit of claim 4 further comprising a resistor coupled between the converter power stage and the first power supply input terminal, the current sense circuit sensing the current through the resistor.

6. The circuit of claim 4 wherein the pulse width modulator comparator comprises a switch driver having a first terminal connected to the output of the voltage error amplifier and a second terminal coupled to a second reference voltage.

* * * * *